United States Patent [19]

Lehmkuhl et al.

[11] Patent Number: 5,007,991

[45] Date of Patent: Apr. 16, 1991

[54] ORGANOALUMINUM ELECTROLYTES FOR THE ELECTROLYTIC DEPOSITION OF HIGH-PURITY ALUMINUM

[75] Inventors: Herbert Lehmkuhl; Klaus-Dieter Mehler, both of Mülheim/Buhr, Fed. Rep. of Germany

[73] Assignee: Studiengesellschaft Kohle mbH, Mulheim/Ruhr, Fed. Rep. of Germany

[21] Appl. No.: 533,321

[22] Filed: Jun. 5, 1990

[30] Foreign Application Priority Data

Jun. 10, 1989 [DE] Fed. Rep. of Germany ..... 3919068

[51] Int. Cl.[5] ..... C25C 3/18

[52] U.S. Cl. ..... 204/58.5; 204/67

[58] Field of Search ..... 204/39, 58.5, 67

[56] References Cited

U.S. PATENT DOCUMENTS

| | | | |
|---|---|---|---|
| 2,849,349 | 8/1958 | Ziegler et al. | 204/58.5 |
| 3,268,421 | 8/1966 | McGraw | 204/39 |
| 3,448,134 | 6/1969 | McGraw | 204/39 X |
| 3,672,965 | 6/1972 | Harwood | 204/58.5 |
| 4,071,526 | 1/1978 | Dotzer et al. | 204/58.5 X |
| 4,144,140 | 3/1979 | Dotzer et al. | 204/58.5 |
| 4,152,220 | 5/1979 | Wong | 204/58.5 |
| 4,417,954 | 11/1983 | Birkle et al. | 204/58.5 |
| 4,778,575 | 10/1988 | Mayer | 204/58.5 |
| 4,948,475 | 8/1990 | Doetzer et al. | 204/58.5 |

*Primary Examiner*—John F. Niebling
*Assistant Examiner*—William T. Leader
*Attorney, Agent, or Firm*—Sprung Horn Kramer & Woods

[57] ABSTRACT

The invention relates to organoaluminum electrolytes for the electrolytic deposition of high-purity aluminum, which are characterized in that they contain mixtures of organoaluminum complex compounds of the type MF.2 $AlR_3$ (A), wherein M represents potassium or mixtures of K with a maximum of about 15% by mole of sodium, as well as trialkylaluminum $AlR_3$ (B) which has not been complexed to an alkali metal fluoride in a molar ratio of A:B of from 4:0.6 to 4:2, as well as a polyfunctional Lewis base of the type $R'$-$OCH_2CH_2$-$OR''$ (C) in a molar ratio of B:C of from 1:0.5 to 1:1. The organyl radicals R in A are ethyl groups (Et), methyl groups (Me) and iso-butyl groups (iBu) in a molar ratio of Et:Me:iBu as 3:m:n, wherein m and n are numerical values of between 1.1 and 0 and the sum (m+n) is from 0.75 to 1.4. As the solvent for said electrolytes there are used from 3 to 4.5 moles, relative to the amount of alkali metal fluoride employed, of an aromatic hydrocarbon which is liquid at 0° C. or a mixture of such hydrocarbons. The invention further relates to a process for the electrolytic deposition of high-purity aluminum by using said electrolytes.

12 Claims, No Drawings

ORGANOALUMINUM ELECTROLYTES FOR THE ELECTROLYTIC DEPOSITION OF HIGH-PURITY ALUMINUM

The invention relates to organoaluminum electrolytes for the electrolytic deposition of high-purity aluminum by using soluble anodes made of the aluminum to be refined, and to a process therefor.

Organoaluminum complex compounds have been used for the electrolytic deposition of aluminum since long {Lit. 1: Dissertation H. Lehmkuhl, TH Aachen 1954; Lit. 2: Angew. Chem. 67 (1955) 424; Lit. 3: DE-PS 1 047 450; Lit. 4: Z. anorg. Chem. 283 (1956) 414; Lit. 5: Chem. Ber. 92 (1959) 2320; Lit. 6: Chem. Ing. Tech. 36 (1964) 616; Lit. 7: DE-PS 1 056 377}. As the electrolytes there have been proposed complexes of the general type MX . 2 $AlR_3$ which are employed either as molten salts or in the form of their solutions in liquid aromatic hydrocarbons. MX are either alkali metal halides or onium halides, preferably fluorides. R are alkyl groups or hydrogen.

Superhigh-purity aluminum is a very important starting material for electronic components. The so far most important application is the use for conductive and contacting layers on microprocessors and memory chips. The organoaluminum electrolytes that are electrolyzed in closed systems at moderate temperatures between 60° C. and 150° C., due to the particular selectivity of these compounds in the dissolution reaction of the metal anodes, are of great technical importance in refining aluminum to produce superhigh-purity grades of at least 99.999% and even higher purity (Lit. 1; Lit. 4). Due to the chemism of the anode reaction in these organoaluminum electrolytes, the transition metals present as impurities in the aluminum to be refined as well as Si, Ge, As are depleted in the refined metal and accordingly much accumulated in the anode slime (Lit. 6).

So far there have been investigated in greater detail as electrolytes for the organometal refining of aluminum:

1. Melts of NaF . 2 $AlEt_3$ (Lit 1–4, 6).

With this electrolyte, current densities of 2.3 A/dm$^2$ may be employed (Lit. 6). One drawback is its self-ignitibility upon contact with air or oxygen. The degree of purity of the refined aluminum cathodically deposited has been reported to be ≧99.999%, based on the analytical methods available at that time (Lit. 1, 2, 4, 6). The cathodic and anodic current yields were 98–100% at current densities up to 1.1 A/dm$^2$ (Lit. 1).

2. Solutions of NaF . 1.25 $AlEt_3$ to NaF . 1.50 $AlEt_3$ in 1 mole of toluene per mole of NaF {Lit. 8: Aluminium 37 (1961) 267}.

The advantage of these electrolytes is a reduced self-ignitibility. Disadvantages are reduced conductivities and current density limitations to values of ≦0.5 A/dm$^2$.

3. Solutions of NaF . 2 $AlEt_3$ in 1 mole of toluene per mole of NaF {Lit. 9: Raffinationsverfahren in der Metallurgie, Verlag Chemie 1983, pages 55–68}.

As the most beneficial operational conditions there are indicated 100° C. and current densities of 0.35 A/dm$^2$.

In the electrolyte systems quoted under the items 2. and 3. the reduced self-ignitibility has been attained by reducing the concentration of trialkylaluminum and/or diluting with toluene at the expense of compromising the applicable current density load. However, the use of a current density as high as possible is of great importance for assessing an electrolyte system, since the space-time yield will depend thereon. Further important criteria of assessment are the thermal stability of the electrolyte, the electrolytic conductivity, the formation of aluminum deposits which are as compact as possible without any co-deposition of alkali metal, and the retention of homogeneous liquid phases even upon cooling to from 20° C. to 0° C., because otherwise malfunctions would occur due to crystallization in cases of discontinuation of the operation or troubles in the course thereof in unheated pipe conduits or pumps.

It has been known that potassium fluoride . 2 trialkylaluminum complexes are better electrolytic conductors than are the analogous respective sodium fluoride compounds (Lit. 1). It is a disadvantage inherent to these complexes containing potassium fluoride that in general they have melting points higher than those of the corresponding sodium compounds and, therefore, have a higher tendency to crystallize from solution in aromatic hydrocarbons. It has further been known that known 1:2 complexes of the type MF . 2 $AlEt_3$ comprising alkyl moieties of low carbon number (e.g. Me, Et) are virtualle not miscible with excessive trialkyl aluminum $AlR_3$. Thus, NaF . 2 $AlEt_3$ which is liquid at 35° C. forms two non-miscible phases with $AlEt_3$ {Lit. 1, Lit. 10: Liebigs Ann. Chem. 629 (1960) 33}.

Therefrom ensues the object to provide electrolytes for the deposition of high-purity aluminum which in an optimal manner combine the properties required for a technical application in aluminum refining such as a conductivity as high as possible and an applicable current density load up to in excess of 6 A/dm$^2$, an aluminum deposit formed as compact as possible, a high selectivity in dissolving the aluminum anode and a homogeneous solubility down to temperatures of from 20° C. to 0° C.

Now it was unexpectedly found that mixtures comprising certain organoaluminum complexes together with organoaluminum, certain bifunctional Lewis bases of the type of the 1,2-dialkoxyalkane and aromatic hydrocarbons which are liquid at room temperature such as toluene and/or a liquid xylene within certain narrow mixing ratios have optimum electrolyte properties for refining aluminum, notwithstanding the infavourable property profiles owned by their individual components. Thus, the non-complexed aluminum alkyls {Lit. 11: Angew. Chem. 67 (1955) 525}, 1,2-dialkoxyalkane and toluene or xylene are virtually electrolytic non-conductors. The inherent conductivity of triethylaluminum in hydrocarbons, e.g., is about $10^{-8}$ S.cm$^{-1}$ (Lit. 11). KF . 2 $AlEt_3$ and KF . 2 $AlMe_3$, although they are good electrolytic conductors, have relatively high melting points of 127°–129° C. and at 151°–152° C., respectively, and, thus, are not very good soluble in toluene so that for solubilizing relatively large amounts of toluene are necessary. On the other hand, KF . 2 $Al(iBu)_3$, although it melts at already 51°–53° C., exhibits a poor utilizable current density load. It is already upon electrolysis at 0.4 A/dm$^2$ that gray potassium-containing deposits are formed at the cathode (Lit. 1).

The invention relates to organoaluminum electrolytes for the electrolytic deposition of high-purity aluminum which are characterized in that they contain mixtures of organoaluminum complex compounds of the type MF . 2 $AlR_3$ (A), wherein M represents potassium or mixtures of K with a maximum of about 15% by mole of sodium, as well as trialkylaluminum $AlR_3$ (B)

which has not been complexed to an alkali metal fluoride in a molar ratio of A:B of from 4:0.6 to 4:2, as well as a polyfunctional Lewis base of the type R'-$OCH_2CH_2$-OR" (C) in a molar ratio of B:C of from 1:0.5 to 1:1. The organyl radicals R in A are ethyl (Et), methyl (Me) and iso-butyl (iBu) groups in a molar ratio of Et:Me:iBu as 3:m:n, wherein m and n are numerical values of between 1.1 and 0 and the sum (m+n) is to amount to from 0.75 to 1 4, and preferably from 0.9 to 1.1.

The trialkylaluminum $AlR_3$ (B) which has not been complexed to an alkali metal fluoride (e.g. KF) preferably is $AlEt_3$ or $Al(iBu)_3$ or a mixture of these two components. The molar mixing ratios of the sum of the alkali metal fluoride . 2 $AlR_3$ complexes (e.g. KF . 2 $AlR_3$) to $AlR_3$ which has not been bonded to an alkali metal fluoride (e.g. KF) preferably are from 4:1.0 to 4:1.6. The molar ratio of the aluminum trialkyls $AlR_3$ which have not been coordinated to an alkali metal fluoride (e.g. KF) to the polyfunctional Lewis base preferably is between 1:0.5 and 1:0.8. Therein, R' and R" may be alkyl, aryl or $OCH_2CH_2OR'''$ groups, wherein R''' represents R' or R".

Bifunctional Lewis bases of the type of the 1,2-dialkoxyalkane $R'OCH_2CH_2OR''$ with R'=R"=Me or Et or R'=Me and R"=Et are preferred. The multi-component electrolytes defined according to the invention form homogeneous liquid systems with toluene, meta- or orthoxylene or other hydrocarbons which are liquid at 0° C., which systems are especially suitable for the electrolytic refining of aluminum. The amount of aromatic hydrocarbon should be from 3 to 4.5 moles, and preferably from 3 to 3.5 moles, per 1 mole of the alkali metal fluoride (e.g. KF). Any further dilution with the solvent is inexpedient because of the reduction in the conductivity associated therewith. At substantially lower solvent contents the systems tend to undergo partially crystallization upon cooling. In the multi-component electrolytes, the alkali metal fluoride . 2 $AlR_3$ complexes (e.g. KF . 2 $AlR_3$) impart good electrolytic conductivity. The addition of $AlR_3$ which has not been complexed to an alkali metal fluoride (e.g. KF) permits the application of high current densities up to more than 6 A/dm$^2$, and the presence of the bifunctional Lewis base of the 1,2-dialkoxyalkane type results in the formation of very compact aluminum deposits. In contrast thereto, in the absence of said Lewis bases a highly dendritic growth of the aluminum on the cathode is observed which will readily produce a short circuit between cathode and anode. Preferred working temperatures for the electrolysis are 80°-130° C. for systems containing meta-xylene and 90°-105° C. for systems containing toluene.

Electrolyte systems according to the invention have been set forth in Table 1 by way of example. The compositions need not be accurately as indicated, but an approximate compliance will do as well. The formulae have been written so that it may be recognized from which constituent components the electrolytes have been composed. This does not involve any statement of that in the multi-component mixtures they are actually present unchanged in the same initial forms.

Since it has been known (Lit. 1) that the trialkylaluminum compounds $AlMe_3$ and $AlEt_3$ will displace the triisobutylaluminum from KF . 2 $Al(iBu)_3$ from the complex bonding to KF according to $$KF \,.\, 2\, Al(iBu)_3 + AlMe_3 \rightarrow KF \,.\, AlMe_3 \,.\, Al(iBu)_3 + Al(iBu)_3,$$

in the electrolytes according to the invention there will also be released triisobutylaluminum from KF . 2 $Al(iBu)_3$ upon the addition of $AlEt_3$ or $AlMe_3$. In the same manner the $AlEt_3$ complex-bonded in NaF . 2 $AlEt_3$ will be displaced by $AlMe_3$ upon addition of $AlMe_3$, e.g. upon an addition in a molar ratio of 1:1 according to the equation $$NaF \,.\, 2\, AlEt_3 + AlMe_3 \rightarrow NaF \,.\, AlMe_3 \,.\, AlEt_3 + AlEt_3.$$

Hence, the tendencies for complex formation of the aluminum trialkyls decrease in the sequence $AlMe_3 > AlEt_3 > Al(iBu)_3$. $Al(iBu)_3$ is displaced from the alkali fluoride complexes of the $Al(iBu)_3$ by $AlMe_3$ or $AlEt_3$, and $AlEt_3$ is displaced from the corresponding $AlEt_3$ complexes only by $AlMe_3$.

This effect may be utilized in the preparation of the multi-component electrolytes. Thus, absolutely identical electrolytes will be obtained, no matter whether (a) a mixture comprising 0.75 moles of KF . 2 $AlEt_3$ and 0.25 moles of KF . 2 $AlMe_3$ in 3 moles of toluene is charged and admixed with 0.25 moles of $Al(iBu)_3$ and 0.25 moles of $MeOCH_2CH_2OMe$, or (b) a mixture comprising 0.75 moles of KF . 2 $AlEt_3$, 0.125 moles of KF . 2 $AlMe_3$ and 0.125 moles of KF . 2 $Al(iBu)_3$ in 3 moles of toluene is charged, and 0.25 moles of $AlMe_3$ and 0.25 moles of $MeOCH_2CH_2OMe$ are dropwise added thereto, or (c) 0.25 moles of $AlEt_3$ and 0.25 moles of $MeOCH_2CH_2OMe$ are added to a mixture comprising 0.625 moles of KF . 2 $AlEt_3$, 0.25 moles of KF . 2 $AlMe_3$ and 0.125 moles of KF . 2 $Al(iBu)_3$ in 3 moles of toluene, or (d) 0.25 moles of the complex $Al(iBu)_3$. $MeOCH_2CH_2OMe$ is added to a mixture comprising 0.75 moles of KF . 2 $AlEt_3$ and 0.25 moles of KF . 2 $AlMe_3$ in 3 moles of toluene.

TABLE 1

Multi-Component Systems for Electrolytic Refining of Aluminum

| Organyl radicals bound in the MF.2 $AlR_3$ complexes[a] Molar ratio of Et:Me:iBu | $AlR_3$ not complexed to MF Molar ratio of MF:$AlR_3$ | $R'OCH_2CH_2OR''$ $AlR_3$:$R'OCH_2CH_2OR''$ | Solvent moles/moles of MF | Remarks Crystallization Specific Conductivity $\chi$ |
|---|---|---|---|---|
| 3:1:0 | $Al(iBu)_3$ 4:1 | $MeOCH_2CH_2OMe$ 1:1 | Toluene 3 | No crystallization down to 0° C. |
| 3:0.9:0 | $Al(iBu)_3$ 4:0.92 $AlEt_3$ 4:0.32 | $MeOCH_2CH_2OMe$ 1:0.75 | Toluene 3 | $\chi$ (95° C.) = 24.5 mS.cm$^{-1}$ No crystallization down to 0° C. |
| 3:1:0 | $Al(iBu)_3$ 4:1 | $MeOCH_2CH_2OMe$ 1:1 | meta-Xylene 3 | No crystallization down to 0° C. $\chi$ (95° C.) = 16.7 mS.cm$^{-1}$ |
| 3:0.5:0.5 | $Al(iBu)_3$ 4:1 | $MeOCH_2CH_2OMe$ 1:1 | meta-Xylene 3 | |

TABLE 1-continued

| Organyl radicals bound in the MF.2 $AlR_3$ complexes[a] Molar ratio of Et:Me:iBu | Multi-Component Systems for Electrolytic Refining of Aluminum: $AlR_3$ not complexed to MF Molar ratio of MF:$AlR_3$ | $R'OCH_2CH_2OR''$ $AlR_3$:$R'OCH_2CH_2OR''$ | Solvent moles/moles of MF | Remarks Crystallization Specific Conductivity $\chi$ |
|---|---|---|---|---|
| 3:1:0 | $AlEt_3$ 4:1.2 | $MeOCH_2CH_2OMe$ 1.2:0.6 | Toluene 3 | Homogeneously liquid to 35° C. $\chi$ (95° C.) = 28.8 $mS.cm^{-1}$ |
| 3:1:0 | $AlEt_3$ 4:1.6 | $MeOCH_2CH_2OMe$ 1.6:0.8 | Toluene 4 | |
| 3:0.83:0[b] | $Al(iBu)_3$ 4:0.83 $AlEt_3$ 4:0.37 | $MeOCH_2CH_2OMe$ 1:0.76 | Toluene 3 | No crystallization down to 0° C. |

[a]M represents potassium, unless otherwise stated;
[b]Molar ratio K:Na = 9:1; $\chi$ (95° C.) = 23.2 $mS.cm^{-1}$.

EXAMPLE 1

An electrolyte system according to the invention was obtained from 0.51 moles of KF . 2 $AlMe_3$, 1.53 moles KF . 2 $AlEt_3$, 647 ml of toluene, 0.59 moles of $AlEt_3$ and 0.30 moles of $MeOCH_2CH_2OMe$. Electrolysis was carried out in a closed electrolytic cell at 95°-98° C. under a protective gas. A sheet of pure aluminum was arranged as a cathode between two anodes at distances of 30 mm from each of both said anodes made of the aluminum to be refined. Electrolysis was conducted at current densities of 1.5 $A/dm^2$ for the cathode and 2.3 $dm^2$ for the anodes at a cell voltage of 2.7 V and a current of 3.0 A for 66.2 hours. During this period, 66.69 g of aluminum had been dissolved, which is 99.3% of the theoretical amount. The cathodic current yield was quantitative.

EXAMPLE 2

An electrolyte prepared from KF . 2 $AlEt_3$, KF . 2 $AlMe_3$, $Al(iBu)_3$ and dimethoxyethane in a molar ratio of 3:1:1:1 in 3 moles of xylene per mole of KF was electrolyzed at 120° C. between two aluminum electrodes with 3 $A/dm^2$. A thick silvery-lustrous somewhat warty aluminum deposit was obtained. The anodic current yield was 99.7%, the cathodic current yield was quantitative.

EXAMPLE 3

The electrolyte described in Example 2 was electrolyzed at 97°-98° C. with 2.8 volt and 0.18 A and current densities up to 6 $A/dm^2$. A thick silvery-lustrous warty aluminum deposit was obtained. The electrolyte remains liquid also when cooled at 0° C. for weeks of storage.

EXAMPLE 4

In the same manner as in Example 2 the same components were dissolved in 3 moles of toluene in the place of xylene. The resulting electrolyte also remained a homogeneous liquid down to 0° C. However, in comparison to the xylene solution, it has a substantially higher conductivity of 25.5 $mS.cm^{-1}$ at 95° C. The conductivity of the xylene solution at the same temperature is 16.7 $mS.cm^{-1}$.

EXAMPLE 5

An electrolyte prepared from KF . 2 $AlEt_3$, KF . 2 $AlMe_3$, $AlEt_3$ and $EtOCH_2CH_2OEt$ or $MeOCH_2CH_2OEt$ in a molar ratio of 3:1:1.6:0.8 in 4 moles of toluene per mole of KF was electrolyzed between two aluminum electrodes at 93°-96° C. in three different experiments with 3 $A/dm^2$ (3.7 volt; 0.88 A), with 4.5 $A/dm^2$ (5.4 volt; 1.32 A), and with 6.0 $A/dm^2$ (6.2 volt; 1.78 A). In each case there were obtained bright shiny crystalline aluminum deposits. At 6 $A/dm^2$ lump formation was observed at the edges of the cathode. The cathodic and anodic current yields were 100 and 99.4%, 99.6 and 99.6% as well as 99.8 and 99.3%.

EXAMPLE 6

The same electrolyte systems as described in Examples 2 or 4 were obtained by combining 2 moles of $K[Et_3AlF]$, 1 mole of $AlEt_3$, 1 mole of $AlMe_3$, 0.5 moles of $Al(iBu)_3$ and 0.5 moles of dimethoxyethane in 6 moles of meta-xylene or toluene. The electrolyses conducted with these systems produced the same results as described in Examples 2 to 4.

EXAMPLE 7

Electrolyte systems of the Examples 2 and 4 were obtainable also by dropwise adding at 50°-60° C. to a suspension of 2 moles of dried potassium fluoride in 6 moles of xylene or toluene first 2 moles of $AlEt_3$ and then, after cooling to about 30° C., a mixture of 1 mole of $AlEt_3$, 1 mole of $AlMe_3$ and 0.5 moles of $Al(iBu)_3$. This was followed by the addition of 0.5 moles of $MeOCH_2CH_2OMe$.

EXAMPLE 8

An electrolyte prepared from 94.7 mmoles of KF . 2 $AlEt_3$, 30.1 mmoles of KF . 2 $AlMe_3$, 13.8 mmoles of NaF . 2 $Al(iBu)_3$, 40.4 mmoles of $AlEt_3$ and 31.5 mmoles of $MeOCH_2CH_2OMe$ in 416 mmoles of toluene was electrolyzed at 95° C. between two aluminum anodes. With a cathodic current density of 3 $A/dm^2$, a coarsely crystalline warty shiny aluminum deposit was obtained. The anodic current yield was 98.4%, the cathodic current yield was quantitative. The purity of the aluminum cathodically deposited was >99.999%.

EXAMPLE 9

An electrolyte identical to that of Example 8 was obtained by mixing 94.7 mmoles of KF . 2 $AlEt_3$, 30.1 mmoles of KF . 2 $AlMe_3$, 13.8 mmoles of NaF . 2 $AlEt_3$, 12.8 mmoles of $AlEt_3$, 27.6 mmoles of $Al(iBu)_3$, and 31.5 mmoles of $MeOCH_2CH_2OMe$ with 416 mmoles of toluene.

EXAMPLE 10

An electrolyte prepared by dissolving 96.1 mmoles of KF . 2 $AlEt_3$, 28.7 mmoles of KF . 2 $AlMe_3$, 10.0 mmoles of $AlEt_3$ . MeOCH and 28.7 mmoles of $Al(iBu)_3$ $MeOCH_2CH_2OMe$ in 371 mmoles of toluene at 60°-70° C. was electrolyzed at 95° C. between two aluminum anodes. With a cathodic current density of 3 $A/dm^2$, a bright grey warty aluminum deposit without dendrite formation was obtained. The anodic and cathodic current yields were quantitative. The purity of the aluminum cathodically deposited was >99.999%.

EXAMPLE 11

An electrolyte identical to that of Example 10 was obtained by dissolving 67.4 mmoles of KF . 2 $AlEt_3$, 57.4 mmoles of KF . $AlMe_3$ . $AlEt_3$, 10.0 mmoles of $AlEt_3$ . $MeOCH_2CH_2OMe$, and 28.7 mmoles of $Al(iBu)_3$ . $MeOCH_2CH_2OMe$ in 371 mmoles of toluene at 60°-70° C.

We claim:

1. In the electrolytic deposition of highly pure aluminum employing an organoaluminum electrolyte, the improvement which comprises effecting the deposition in a toluene solution of an electrolyte at a temperature of from 90° C. to 105° C. or in a xylene solution of an electrolyte at a temperature of from 80° C. to 135° C. and employing as the electrolyte mixtures of organoaluminum complex compounds of the formula MF . 2 AlR (A), wherein M represents potassium or mixtures of potassium with a maximum of about 15% by mole of sodium, as well as trialkylaluminum AlR (B) which has not been complexed to an alkali metal fluoride in a molar ration of A:B of from 4:0.6 to 4.2, as well as a polyfunctional Lewis base of the formula R'-$OCH_2CH_2$-OR'' (C) in a molar ratio of B:C of from 1:0.5 to 1.1, wherein R is an alkyl group, and R' and R'' are alkyl, aryl or $OCH_2CH_2OR'''$ with R''' being an alkyl or aryl group.

2. The process according to claim 1 wherein the electrolyte has been dissolved in from 3 to 4.5 moles, relative to the amount of alkali metal fluoride employed, of toluene or a xylene.

3. Organoaluminum electrolytes for the electrolytic deposition of high-purity aluminum, characterized in that they contain mixtures of organoaluminum complex compounds of the formula MF . 2 $AlR_3$ (A), wherein M represents potassium or mixtures of potassium with a maximum of about 15% by mole of sodium, as well as trialkylaluminum $AlR_3$ (B) which has not been complexed to an alkali metal fluoride in a molar ratio of A:B of from 4:0.6 to 4:2, as well as a polyfunctional Lewis base of the formula R'-$OCH_2CH_2$-OR'' (C) in a molar ratio of B:C of from 1:0.5 to 1:1, wherein R is an alkyl group, and R' and R'' are alkyl, aryl or $OCH_2CH_2OR'''$ with R''' being an alkyl or aryl group.

4. The electrolytes according to claim 3, characterized in that the organyl radicals R in the complex compounds MF . 2 $AlR_3$ (A) are ethyl groups (Et), methyl groups (Me) and iso-butyl groups (iBu) in a molar ratio of Et:Me:iBu as 3:m:n, wherein m and n are numerical values of between 1.1 and 0 and the sum (m+n) is from 0.75 to 1.4.

5. The electrolytes according to claim 3, characterized in that MF is potassium fluoride.

6. The electrolytes according to claim 3, characterized in that the trialkylaluminum $AlR_3$ (B) is $AlEt_3$ or $Al(iBu)_3$ or consists of a mixture of $AlEt_3$ and $Al(iBu)_3$.

7. The electrolytes according to claim 3, characterized in that the molar ratio of A:B is from 4:1 to 4:1.6.

8. The electrolytes according to claim 3, characterized in that they have been dissolved in from 3 to 4.5 moles, relative to the amount of alkali metal fluoride employed, of an aromatic hydrocarbon solvent which is liquid at 0° C.

9. The electrolytes according to claim 8, characterized in that the proportion of the solvent is from 3 to 3.5 moles, relative to the amount of alkali metal fluoride employed.

10. The electrolytes according to claim 8, characterized in that toluene or a liquid xylene is used as the solvent.

11. The electrolytes according to claim 3, wherein the sum (m+n) is from 0.9 to 1.1.

12. The electrolytes according to claim 3, wherein R' and R'' are each independently is a methyl or ethyl group.

* * * * *